US012426732B1

(12) United States Patent
Jones

(10) Patent No.: US 12,426,732 B1
(45) Date of Patent: Sep. 30, 2025

(54) RECONFIGURABLE NECK PILLOW APPARATUS

(71) Applicant: Brook Jones, New York, NY (US)

(72) Inventor: Brook Jones, New York, NY (US)

( * ) Notice: Subject to any disclaimer, the term of this patent is extended or adjusted under 35 U.S.C. 154(b) by 0 days.

(21) Appl. No.: 18/984,366

(22) Filed: Dec. 17, 2024

(51) Int. Cl.
*A47G 9/10* (2006.01)
*A47C 7/38* (2006.01)

(52) U.S. Cl.
CPC ..... *A47G 9/1081* (2013.01); *A47G 9/1009* (2013.01); *A47C 7/383* (2013.01); *A47G 2009/1018* (2013.01)

(58) Field of Classification Search
CPC ..... A47C 16/00; A47C 7/383
See application file for complete search history.

(56) References Cited

U.S. PATENT DOCUMENTS 818,045 A * 4/1906 Perry ..... A47C 7/383 5/643
2,013,481 A 9/1935 Stonehill
2,528,768 A 11/1950 Marsh
2,587,196 A * 2/1952 Morecroft ..... A47C 7/383 5/640
2,589,579 A * 3/1952 Slayen ..... A47C 27/001 5/722
2,667,915 A * 2/1954 Pfeffer ..... A47G 9/10 5/636
2,719,577 A * 10/1955 Eyman ..... B61D 33/005 5/640
2,765,480 A * 10/1956 Mueller ..... A47C 7/425 5/636
3,305,878 A * 2/1967 Hellbaum ..... A47C 27/146 5/653
3,636,576 A * 1/1972 Nissen ..... A63B 6/00 5/420
4,031,578 A * 6/1977 Sweeney ..... B60N 2/882 5/426
4,235,472 A 11/1980 Sparks et al.
4,345,346 A * 8/1982 Holtz ..... A44B 99/00 5/640

(Continued)

FOREIGN PATENT DOCUMENTS

GB 2506112 A * 3/2014 ..... A47C 7/383
JP 2000232928 A * 8/2000 ..... A47C 7/383
JP 2015024108 A * 2/2015 ..... A47C 16/00

*Primary Examiner* — Eric J Kurilla
(74) *Attorney, Agent, or Firm* — Goldstein Law Offices, P.C.

(57) ABSTRACT

A reconfigurable neck pillow apparatus includes a pair of side elements, a pair of upper base elements, a pair of lower base elements, and a panel element. Each of the side elements has an inside surface disposed opposite an outside surface and a bottom edge disposed parallel to a top edge. A side edge extends substantially transversely between the top edge and the bottom edge. Each of the upper base elements is hingedly coupled to a side element. Each of the lower base elements is hingedly coupled to one of the upper base elements. The panel element includes a top end, a bottom end, and a first lateral edge extending between the top end and the bottom end. The first lateral edge is hingedly coupled to the side edge such that the panel element is disposed between and substantially coplanar with the pair of side elements in an extended configuration.

19 Claims, 12 Drawing Sheets

(56) References Cited

U.S. PATENT DOCUMENTS 4,440,443 A * 4/1984 Nordskog ..... B60N 2/882 297/217.4
4,773,707 A * 9/1988 Vadala ..... B60N 2/882 297/391
4,797,934 A * 1/1989 Hufnagel ..... A47C 7/727 297/400
D319,365 S 8/1991 Edelson
5,163,195 A 11/1992 Hill
5,360,017 A 11/1994 Austin
5,613,736 A * 3/1997 Schaked ..... A47C 7/383 5/643
5,669,665 A * 9/1997 Nowak ..... B60N 2/286 297/406
5,975,638 A * 11/1999 Schreiner ..... A47C 7/383 297/DIG. 8
6,123,389 A * 9/2000 O'Connor ..... B60N 2/2851 5/636
6,176,549 B1 * 1/2001 Karash ..... A47C 5/005 297/391
6,893,094 B2 * 5/2005 O'Connor ..... A47C 7/383 5/636
7,055,197 B1 6/2006 Fathali
D638,646 S 5/2011 Penza
8,584,285 B1 11/2013 Sipherd
9,629,487 B1 4/2017 Kvitek
D836,949 S 1/2019 Long et al.
10,202,196 B2 * 2/2019 Hontz ..... B64D 11/0642
D845,674 S 4/2019 Hariri et al.
10,524,596 B2 1/2020 Pesale et al.
D917,928 S 5/2021 Miller
2002/0185573 A1 * 12/2002 Bisch ..... B60N 2/882 248/118
2003/0041380 A1 * 3/2003 Hanley ..... B60N 2/2881 5/640
2004/0217639 A1 * 11/2004 Clough ..... A47C 7/38 297/391
2006/0202522 A1 * 9/2006 Lee ..... A47C 7/383 297/61
2010/0095457 A1 4/2010 Sharp
2011/0271964 A1 * 11/2011 Zhang ..... A61G 13/121 128/845
2012/0084924 A1 4/2012 Cheng
2012/0222218 A1 * 9/2012 Davis ..... A47G 9/1072 5/490
2012/0313417 A1 * 12/2012 Hurwitz ..... A47C 7/383 297/391
2015/0366381 A1 12/2015 Aydemir
2017/0215588 A1 * 8/2017 Trucco ..... A47G 9/10
2017/0332812 A1 * 11/2017 Colton ..... A47G 9/10
2017/0340125 A1 * 11/2017 Miller ..... A47C 16/00
2018/0049568 A1 * 2/2018 Cruz ..... A47C 27/082
2021/0037982 A1 2/2021 Schwendeman et al.
2022/0063466 A1 * 3/2022 Ilker ..... B60N 2/885

* cited by examiner

RECONFIGURABLE NECK PILLOW APPARATUS

TECHNICAL FIELD

The present disclosure relates generally to pillows. More particularly, the present disclosure relates to travel pillows.

BACKGROUND

Travel, particularly on airplanes, often involves prolonged periods of sitting in confined spaces. For many travelers, achieving restful sleep or simply finding a comfortable position in such environments is challenging. Frequently, discomfort arises from lack of proper head and neck support, which can lead to strain, discomfort, and inadequate rest. Many neck pillows currently on the market offer limited functionality, typically supporting only a singular position or configuration. This limitation can reduce their effectiveness and adaptability across different travel situations or user preferences.

What is needed is a reconfigurable neck pillow that addresses the limitations of traditional neck pillows and offers enhanced comfort and support across a range of travel scenarios. Beneficially, such a reconfigurable neck pillow would offer multiple configurations tailored to accommodate different seating and sleep scenarios useful in connection with public transport. What is also needed is a reconfigurable neck pillow that offers baseline support, maintains proper neck alignment in seated positions, and helps prevent neck strain and unwanted head movement during sleep.

BRIEF SUMMARY

According to one aspect of the present disclosure, a reconfigurable neck pillow apparatus includes multiple interconnected cushions. The interconnected cushions include a pair of side elements, a pair of upper base elements, a pair of lower base elements, and a panel element. In some embodiments, each of the pair of side elements has an inside surface disposed opposite an outside surface and a bottom edge disposed substantially parallel to a top edge. The bottom edge and the top edge extend substantially perpendicularly between the inside surface and the outside surface. A side edge extends substantially transversely between the top edge and the bottom edge.

Each of the pair of upper base elements is hingedly coupled to at least a portion of one of the pair of side elements. Each of the pair of upper base elements includes a first surface disposed opposite a second surface and a top side disposed parallel to a bottom side. The top side extends substantially perpendicularly between the first surface and the second surface. In an extended configuration, the top side is disposed adjacent to the bottom edge of the one of the pair of side elements and each of the pair of upper base elements is substantially coplanar with the one of the pair of side elements.

Each of the pair of lower base elements is hingedly coupled to at least a portion of the second surface of a corresponding one of the pair of upper base elements. Each of the pair of lower base elements includes an outer surface, an inner surface, and an upper edge disposed parallel to a lower edge. The upper edge is disposed adjacent to the bottom side of the corresponding one of the pair of upper base elements in the extended configuration.

The panel element includes a top end, a bottom end, and a first lateral edge extending between the top end and the bottom end. The first lateral edge is hingedly coupled to the side edge such that the panel element is substantially coplanar with the pair of side elements in the extended configuration.

In some embodiments, each of the interconnected cushions includes a rectangular prism shape. In some embodiments, each of the pair of side elements includes a recess disposed along the inside surface. The recess may be configured to accommodate a user's ear.

In some embodiments, each of the pair of upper base elements is coupled to one of the pair of side elements via a first unidirectional hinge. In some embodiments, each of the pair of lower base elements is coupled to the one of the pair of upper base elements via a second unidirectional hinge. In some embodiments, the panel element is coupled to the side edge via a third hinge.

In some embodiments, the panel element includes a pair of panel elements having a second lateral edge extending between the top end and the bottom end and disposed parallel to the first lateral edge. In some embodiments, each of the pair of panel elements is substantially rigid. In some embodiments, the pair of panel elements includes a first panel element coupled to a second panel element along the second lateral edge. In some embodiments, the first panel element is coupled to the second panel element via a bidirectional hinge.

In some embodiments, each of the pair of side elements, each of the pair of upper base elements, each of the pair of lower base elements, and each of the panel elements is reconfigurable from the extended configuration to a configuration selected from the group consisting of a standard configuration, a low support configuration, a high support configuration, a block configuration, and a couples' configuration.

The standard configuration may include each of the pair of side elements being disposed orthogonally with respect to the pair of panel elements to form a space to receive a user's head. Each of the pair of upper base elements may be folded with respect to each of the pair of side elements such that the top side aligns with the bottom edge, and each of the pair of lower base elements may be stacked on top of each of the pair of upper base elements such that the lower edge aligns with the top edge.

In some embodiments, the low support configuration includes each of the pair of side elements being disposed orthogonally with respect to the pair of panel elements to form the space to receive the user's head. Each of the pair of upper base elements may be folded with respect to each of the pair of side elements such that the first surface is disposed parallel to and offset from the bottom edge. The second surface of the pair of upper base elements may be disposed adjacent to the outer surface of the pair of lower base elements.

In some embodiments, the high support configuration includes each of the pair of side elements being disposed orthogonally with respect to the pair of panel elements to form the space to receive the user's head. Each of the pair of side elements may be aligned with and disposed on top of each of the pair of upper base elements. Each of the pair of lower base elements may be folded with respect to each of the pair of upper base elements such that the lower edge is coplanar with the bottom side.

In some embodiments, the block configuration includes each of the pair of side elements, each of the pair of upper base elements, and each of the pair of lower base elements being folded onto each other to form a cuboidal shape.

The couples' configuration may include the pair of side elements being folded inwardly onto each other such that the inside surface of one of the pair of side elements is adjacent to the inside surface of another of the pair of side elements. Each of the pair of side elements may be aligned with and disposed on top of each of the pair of upper base elements. Each of the pair of lower base elements may be folded with respect to each of the pair of upper base elements such that the lower edge is coplanar with the bottom side.

In some embodiments, each of the pair of panel elements folds onto the other and extends outwardly in a substantially transverse direction relative to the side edge.

In some embodiments, at least one securing element is configured to releasably couple a first interconnected cushion to a second interconnected cushion. In some embodiments, the securing element includes a first portion coupled to the first interconnected cushion and a second portion coupled to the second interconnected cushion. The first portion may selectively engage the second portion to maintain the plurality of interconnected cushions in the desired configuration.

In some embodiments, a stabilizing element is configured to stabilize the configuration during use. The stabilizing element may be releasably coupled to at least two of the interconnected cushions. In some embodiments, the stabilizing element is configured to span at least a portion of a space formed to receive a user's head.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, most travelers tend to find achieving restful sleep difficult during travel. Currently available neck pillows offer limited functionality, typically supporting only a singular position or configuration. This limitation can reduce their effectiveness and adaptability to various travel situations or user preferences. The present disclosure addresses these and other issues.

Figure 1:
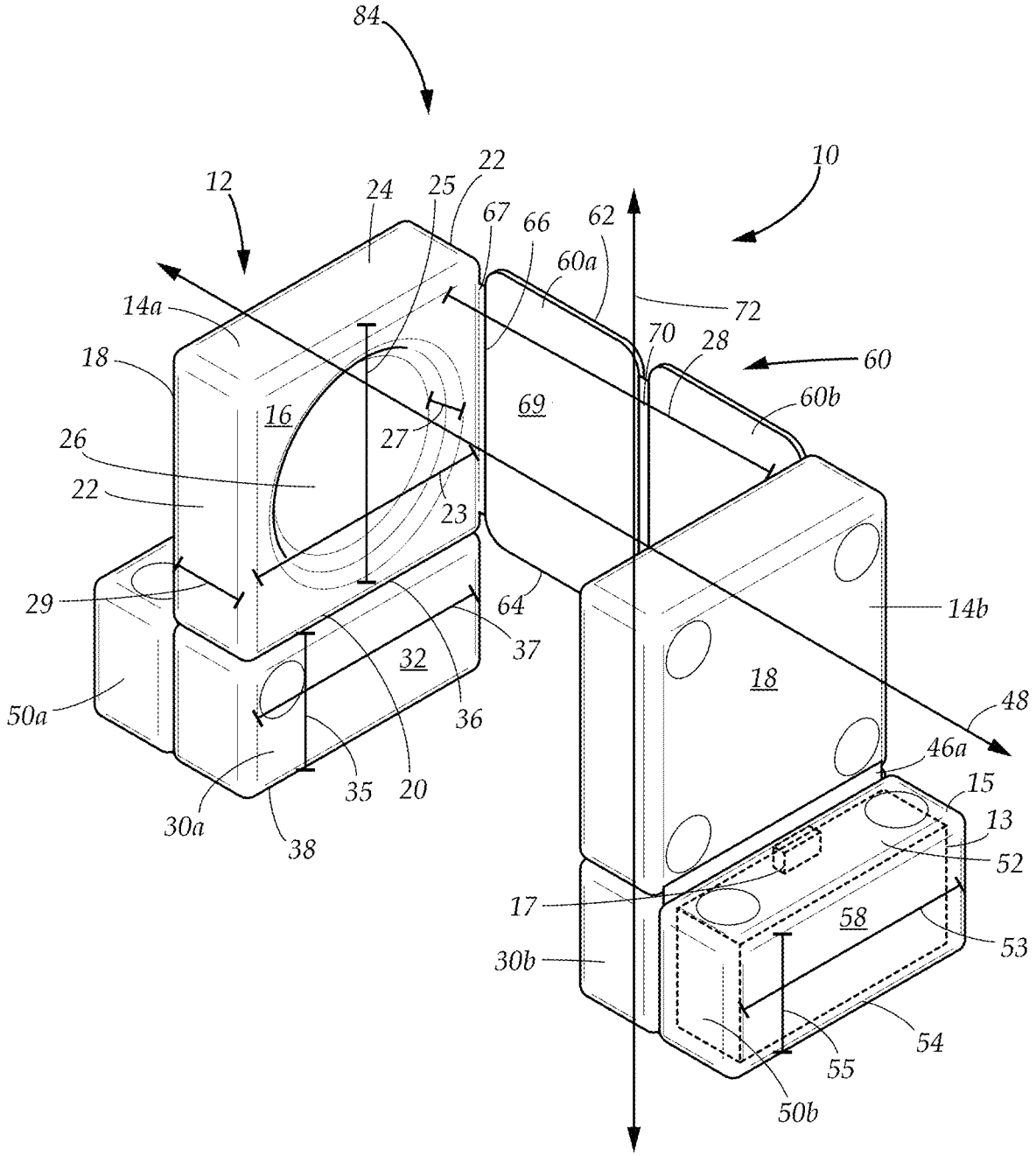
FIG. 1 is a perspective view of one embodiment of a reconfigurable neck pillow apparatus in a high support configuration in accordance with the present disclosure.

Referring now to FIG. 1, a reconfigurable neck pillow apparatus 10 is presented. In some embodiments, the reconfigurable neck pillow apparatus 10 includes multiple interconnected cushions 12 designed for enhanced comfort and support during seated use, such as on an airplane or in a motor vehicle. The interconnected cushions 12 may be configured into various ergonomic arrangements to accommodate different user needs and/or preferences.

In some embodiments, one or more of the interconnected cushions 12 includes a core material 13 substantially encased in a removable fabric cover 15. In some embodiments, a singular fabric cover 15 encloses the entire reconfigurable neck pillow apparatus 10. In other embodiments, the fabric cover 15 may encase a single interconnected cushion 12 or more than one adjacent interconnected cushion 12.

In some embodiments, the removable fabric cover 15 is made from one or more breathable, moisture-wicking materials such as microfiber, jersey knit, or other suitable materials that are comfortable to the touch and easy to clean. In some embodiments, at least a portion of the removable fabric cover 15 includes a non-slip material or coating to facilitate stability against a seatback or tray table during use.

In some embodiments, the fabric cover 15 incorporates one or more releasable fasteners 17, such as magnetic closures, hook-and-loop fasteners, snap buttons, buttons, zippers, and/or any other suitable fasteners to secure one or more of the interconnected cushions 12 inside the fabric cover 15. In some embodiments, the fabric cover 15 is designed to cover all of the interconnected cushions 12 such that the entire reconfigurable neck pillow apparatus 10 is disposed within a single fabric cover 15. In other embodiments, one fabric cover 15 corresponds to each interconnected cushion 12. In still other embodiments, one fabric cover 15 corresponds to more than one interconnected cushion 12.

In some embodiments, the core material 13 of one or more of the interconnected cushions 12 is selected based on its desired properties, such as comfort, durability, weight, and/or cost. In one embodiment, the interconnected cushions 12 include a foam-based material configured to substantially conform to the user's shape and to return to its original form after use. The foam-based material may include, for example, a lightweight memory foam, polyurethane foam, high-density foam, gel-infused foam, latex foam, recycled foam, and/or the like.

In other embodiments, one or more of the interconnected cushions 12 is constructed from an air-filled material such as an inflatable air chamber or hybrid air-foam core that combines foam layers with inflatable chambers for customizable comfort and support. In some embodiments, one or more of the interconnected cushions 12 includes a gel or polymer-based material such as a thermoplastic elastomer (TPE) gel, a silicone gel, and/or a honeycomb polymer structure made from lightweight polymers such as polypropylene or polyethylene. In some embodiments, the interconnected cushions 12 include a natural material such as cork, a synthetic material such as a closed-cell foam made from polyethylene or ethylene-vinyl acetate (EVA), and/or memory gel beads that include small gel beads encased in a memory foam structure. In other embodiments, one or more of the interconnected cushions 12 includes a phase-change material (PCM) foam, an aerogel-infused foam, a bamboo fiber foam, and/or a 3D-printed lattice structure made from lightweight polymers.

In some embodiments, the core material 13 includes internal ventilation channels and/or perforations to enhance airflow and prevent overheating. In one embodiment, the core material 13 includes one or more thin layers of embedded gel to provide a cooling effect and/or enhance pressure distribution. In some embodiments, the core material 13 includes at least one beveled and/or curved edge.

In some embodiments, the reconfigurable neck pillow apparatus 10 includes a pair of side elements 14*a*, 14*b*, a pair of upper base elements 30*a*, 30*b*, a pair of lower base elements 50*a*, 50*b*, and one or more panel elements 60. In some embodiments, a pair of panel elements 60*a*, 60*b* is disposed between the pair of side elements 14*a*, 14*b* along a longitudinal axis 48 of the reconfigurable neck pillow apparatus 10. Further, in some embodiments, the pair of side elements 14*a*, 14*b*, pair of upper base elements 30*a*, 30*b*, pair of lower base elements 50*a*, 50*b*, and pair of panel elements 60*a*, 60*b* are symmetrically disposed about a transverse axis 72 of the reconfigurable neck pillow apparatus 10.

In some embodiments, each of the pair of side elements 14*a*, 14*b* includes a bottom edge 20 disposed substantially parallel to a top edge 24. The bottom edge 20 and the top edge 24 extend substantially perpendicularly between the inside surface 16 and the outside surface 18. A side edge 22 includes a width 29 extending substantially transversely between the top edge 24 and the bottom edge 20. In some embodiments, the pair of side elements 14*a*, 14*b* provides foundational lateral support to prevent a user's head from tilting to the side during use.

In some embodiments, each of the interconnected cushions 12 including the pair of side elements 14*a*, 14*b*, the pair of upper base elements 30*a*, 30*b*, and the pair of lower base elements 50*a*, 50*b*, has a rectangular prism shape. In other embodiments, each of the interconnected cushions 12 includes any suitable shape and/or dimensions. In some embodiments, the shape and/or dimensions of one or more of the interconnected cushions 12 vary with respect to each other. In some embodiments, each of the interconnected cushions 12 includes a shape and/or dimensions configured to facilitate arranging and re-arranging the reconfigurable neck pillow apparatus 10 into various desired configurations, as discussed in more detail below.

In one embodiment, each of the pair of side elements 14*a*, 14*b* has a substantially square prism shape where the dimensions of one side element 14*a* are substantially identical to the dimensions of the other side element 14*b*. In some embodiments, each of the pair of upper base elements 30*a*, 30*b* includes a substantially rectangular prism shape where the height 35 of the upper base element 30*a*, 30*b* is less than or about one-half the height 25 of the side element 14*a*, 14*b*. Similarly, in some embodiments, each of the pair of lower base elements 50*a*, 50*b* includes a substantially rectangular prism shape where the height 55 of the lower base element 50*a*, 50*b* is less than or about one-half the height 25 of the side element 14*a*, 14*b* and/or substantially equal to the height 35 of the upper base element 30*a*, 30*b*. In certain embodiments, the lengths 23, 37, 53 of the side elements 14*a*, 14*b*, upper base elements 30*a*, 30*b*, and lower base elements 50*a*, 50*b*, respectively, are substantially identical.

In some embodiments, each of the pair of side elements 14*a*, 14*b* includes an inside surface 16 disposed opposite an outside surface 18. In some embodiments, the inside surface 16 is slightly curved to conform to the natural contours of the user's head and/or neck, thereby facilitating a snug fit.

In certain embodiments, each of the pair of side elements 14*a*, 14*b* includes a recess 26 or indentation centrally disposed along the inside surface 16 and ergonomically designed to accommodate a user's ear without causing discomfort or undue pressure. In some embodiments, each recess 26 includes a size and shape configured to accommodate the user's ear. For example, in some embodiments, the recess 26 includes a substantially circular, elliptical, or other suitable regular or irregular shape. In some embodiments, a perimeter of the recess 26 is beveled and/or curved to increase user comfort.

In some embodiments, the recess 26 includes a depth 27 that is ¼ to ¾ the width 29 of the side edge 22. In some embodiments, the recess 26 includes a size and/or shape configured to accommodate the user's ear in addition to an earbud, headphone, earphone, hearing aid, and/or other desired electronic device disposed within or adjacent to the user's ear and/or head.

Figure 2:
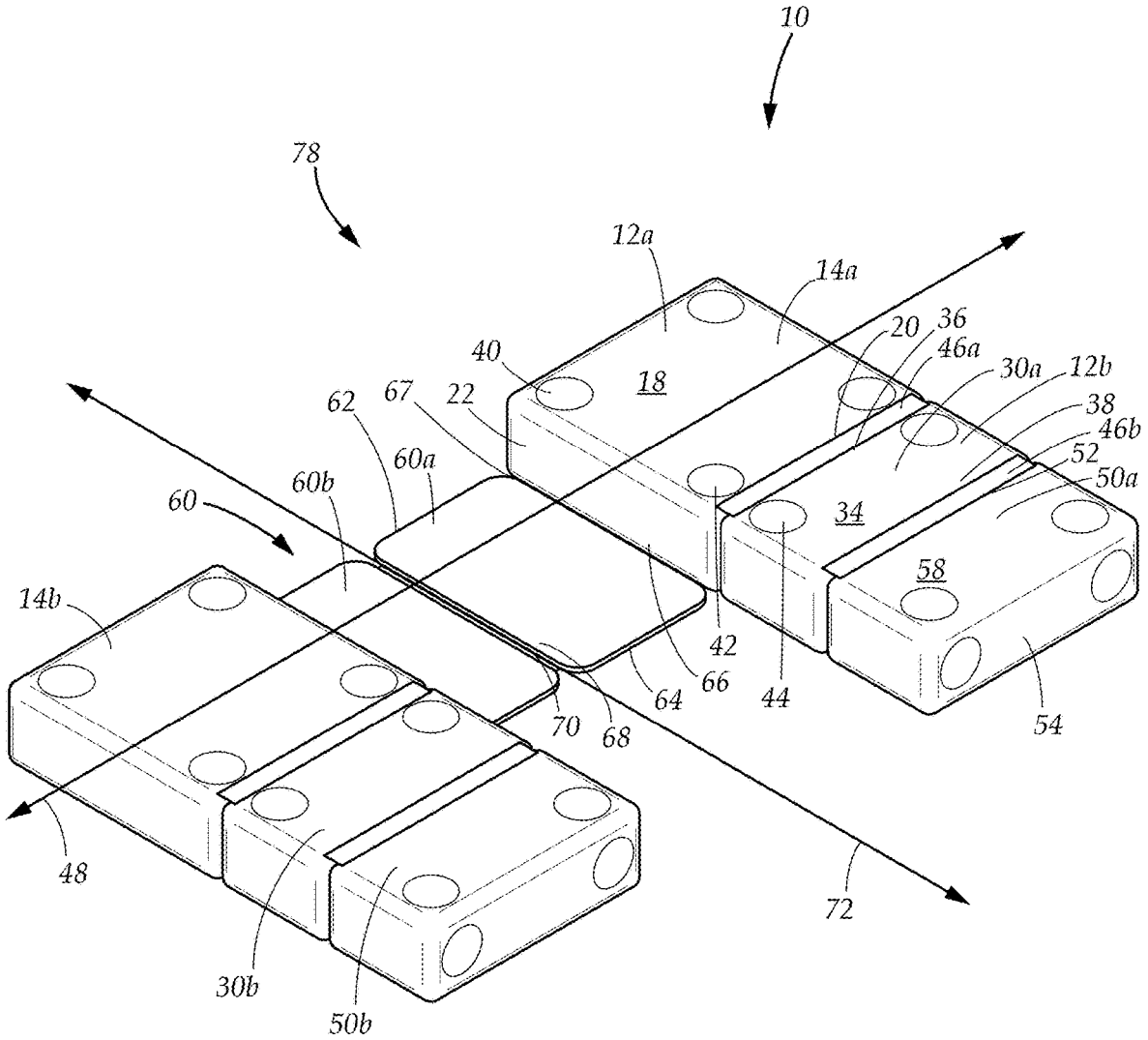
FIG. 2 is a top view of one embodiment of a reconfigurable neck pillow apparatus in an extended configuration in accordance with some embodiments of the present disclosure.
Figure 3:
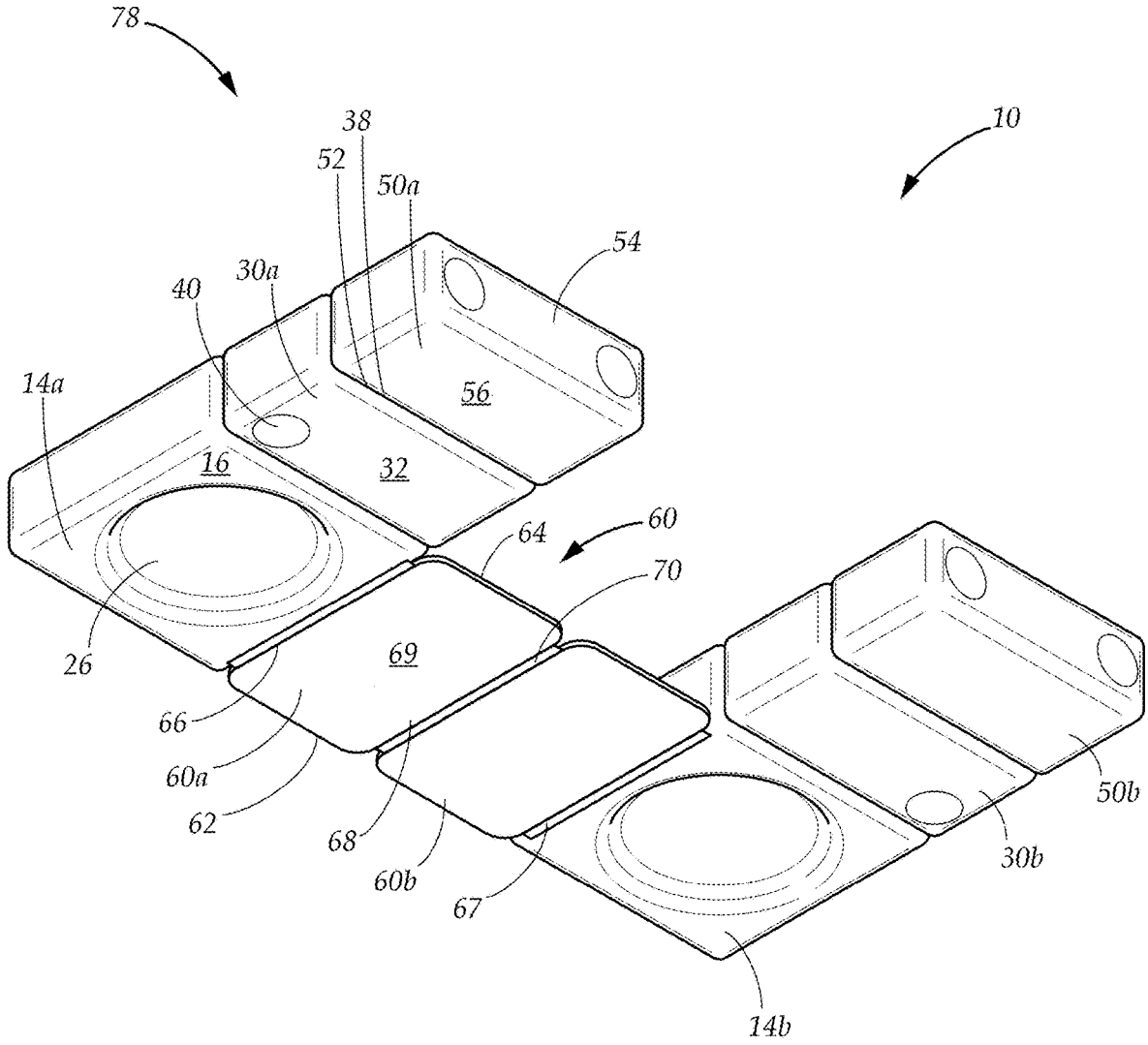
FIG. 3 is a bottom view of the reconfigurable neck pillow apparatus of FIG. 2.

Referring now to FIGS. 2 and 3, while still referring to FIG. 1, each of the pair of upper base elements 30*a*, 30*b* is coupled to at least a portion of a corresponding side element 14*a*, 14*b* via a first unidirectional hinge 46*a*. The first unidirectional hinge 46*a* may allow precise folding in a single outward direction, thereby ensuring structural alignment of the upper base elements 30*a*, 30*b* with the side elements 14*a*, 14*b* during configuration of the reconfigurable neck pillow apparatus 10.

In some embodiments, the first unidirectional hinge 46*a* includes a flexible, durable material such as silicone-coated fabric, reinforced nylon, or any other suitable material configured to provide smooth movement and durability. For example, the first unidirectional hinge 46*a* may include a metal alloy, nylon (polyamide), polyoxymethylene (POM), polypropylene (PP), polycarbonate, thermoplastic polyurethane (TPU), silicone, and/or any other suitable material. The first unidirectional hinge 46*a* may be coupled to the side elements 14*a*, 14*b* and the upper base elements 30*a*, 30*b* via one or more adhesives, stitching, welding, bonding, pins, screws, rivets, grommets, and/or any other suitable mechanical devices and/or mechanisms known to those in the art.

Each of the pair of upper base elements 30*a*, 30*b* includes a first surface 32 disposed opposite a second surface 34, and a top side 36 (shown in FIG. 5) disposed parallel to a bottom side 38. The top side 36 may extend substantially perpendicularly between the first surface 32 and the second surface 34. In an extended configuration 78, the top side 36 may be disposed adjacent to the bottom edge 20 of one of the pair of side elements 14*a*, 14*b* and each of the pair of upper base elements 30*a*, 30*b* may be substantially coplanar with the side elements 14*a*, 14*b*.

In one embodiment, one portion of the first unidirectional hinge 46*a* is coupled to the outside surface 18 of the side element 14*a*, 14*b* and another portion of the first unidirectional hinge 46*a* is coupled to the second surface 34 of the corresponding upper base element 30*a*. The first unidirectional hinge 46*a* may be open in the extended configuration 78. In this manner, the second surface 34 of the upper base element 30*a*, 30*b* may be aligned with the outside surface 18 of the corresponding side element 14*a*, 14*b*, and the first surface 32 of the upper base element 30*a*, 30*b* may be aligned with the inside surface 16 of the corresponding side element 14*a*, 14*b*.

In some embodiments, each of the lower base elements 50*a*, 50*b* is coupled to a corresponding one of the upper base elements 30*a*, 30*b* via a second unidirectional hinge 46*b* similar or identical to the first unidirectional hinge 46*a*. Like the first unidirectional hinge 46*a*, the second unidirectional hinge 46*b* may allow precise folding in one direction, thereby ensuring structural alignment of the lower base elements 50*a*, 50*b* with the upper base elements 30*a*, 30*b* in various configurations.

Each of the pair of lower base elements 50*a*, 50*b* includes an outer surface 58, an inner surface 56, and an upper edge 52 disposed parallel to a lower edge 54. In the extended configuration 78, the second unidirectional hinge 46*b* may be open and the upper edge 52 may be disposed adjacent to the bottom side 38 of a corresponding upper base element 30*a*, 30*b*.

In one embodiment, one portion of the second unidirectional hinge 46*b* is coupled to the second surface 34 of the upper base element 30*a*, 30*b* and another portion of the second unidirectional hinge 46*b* is coupled to the outer surface 58 of the corresponding lower base element 50*a*, 50*b*. In the extended configuration 78, the second unidirectional hinge 46*b* may be open such that the second surface 34 of the upper base element 30*a*, 30*b* is aligned with the outer surface 58 of the corresponding lower base element 50*a*, 50*b*. In some embodiments, the first surface 32 of the upper base element 30*a*, 30*b* is also aligned with the inner surface 56 of the corresponding lower base element 50*a*, 50*b* in the extended configuration 78.

In some embodiments, the panel element 60 includes a top end 62, a bottom end 64, and a first lateral edge 66 extending between the top end 62 and the bottom end 64. The first lateral edge 66 may be coupled to the side edge 22 of at least one of the side elements 14*a*, 14*b*. The panel element 60 may be substantially coplanar with the side element 14*a*, 14*b* in the extended configuration 78.

In some embodiments, the panel element 60 has a substantially flat, rigid, and/or rectangular structure. In some embodiments, the panel element 60 includes a lightweight, durable material such as acrylonitrile butadiene styrene (ABS) plastic, lightweight aluminum, and/or the like. In some embodiments, the panel element 60 includes a rigid insert disposed within the fabric cover 15. The panel element 60 may be configured to maintain its structural integrity and allow for precise hinging and/or alignment when the reconfigurable neck pillow apparatus 10 is reconfigured.

Figure 13:
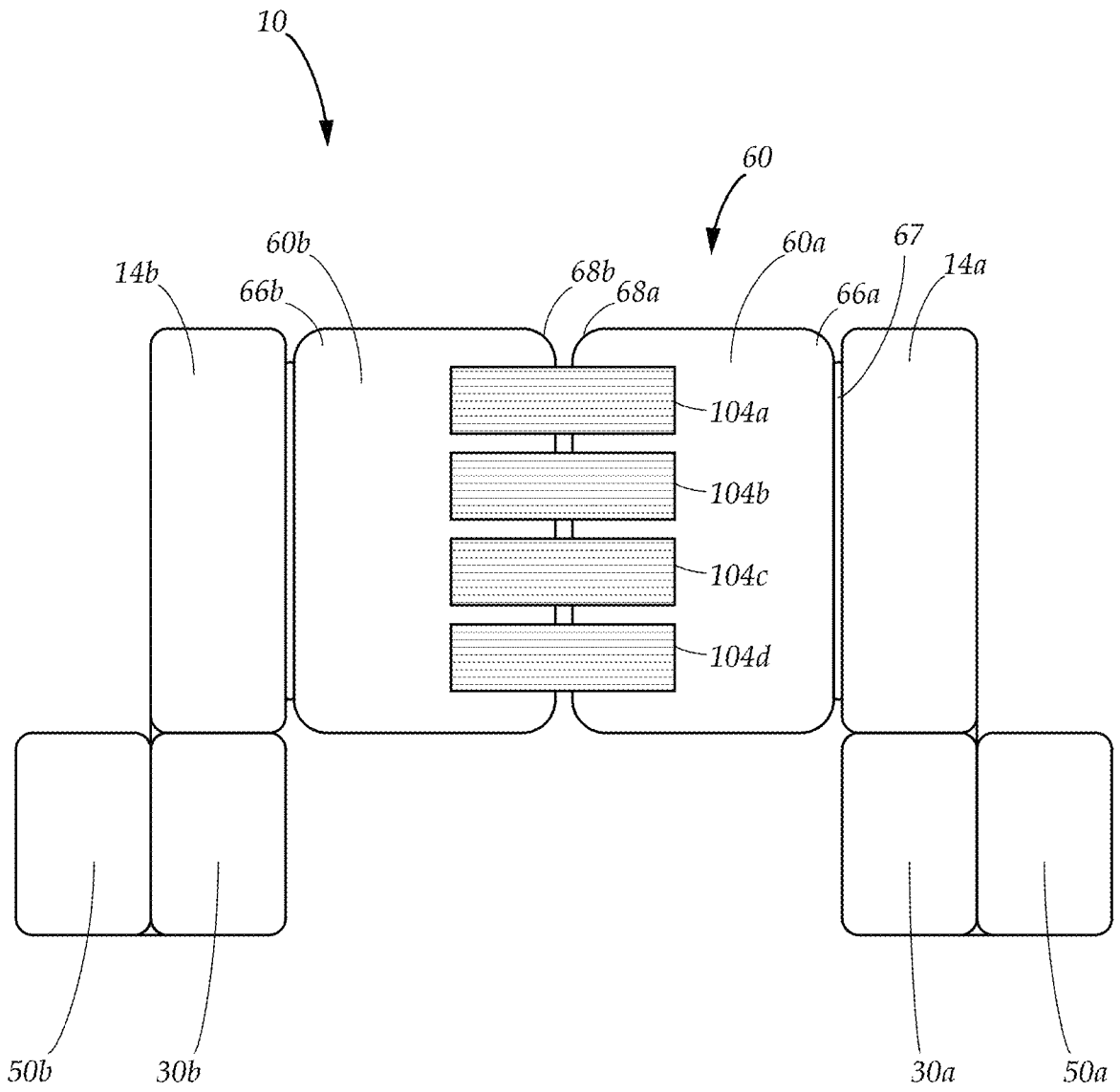
FIG. 13 is a rear view of another embodiment of the reconfigurable neck pillow apparatus that incorporates a biasing element in accordance with some embodiments of the present disclosure.

In other embodiments, the panel element 60 is folded and/or corrugated to facilitate its ability to expand in a lateral direction between the pair of side elements 14*a*, 14*b*. In certain embodiments, as shown in FIG. 13 for example, while still referring to FIGS. 1-3, the panel element 60 includes one or more biasing elements 104*a-d* configured to stretch laterally to facilitate lateral expansion of a space 28 formed between the side elements 14*a*, 14*b*. In one embodiment, multiple biasing elements 104*a-d* are disposed between a pair of panel elements 60*a*, 60*b* to enable controlled lateral expansion between their respective second lateral edges 68*a*, 68*b*. In some embodiments, the panel elements 60*a*, 60*b* include one or more beveled edges to facilitate smooth lateral movement and prevent discomfort during use. In some configurations, each of the panel elements 60*a*, 60*b* substantially aligns with the side elements 14*a*, 14*b* to form a substantially smooth, continuous inner surface configured to cradle the user's head during use. In one embodiment, at least one of the panel elements 60*a*, 60*b* includes a molded surface configured to substantially conform to a shape of the user's head.

In some embodiments, the panel element 60 is coupled to at least one of the side elements 14*a*, 14*b* via a third hinge 67. The third hinge 67 may include a flexible, durable material such as silicone-coated fabric, reinforced nylon, or any other suitable material. In some embodiments, the third hinge 67 is a unidirectional hinge. In other embodiments, the third hinge 67 is a bidirectional hinge configured to enable the panel element 60 to fold inward or outward as desired with respect to the side elements 14*a*, 14*b*.

In some embodiments, as shown in FIGS. 1-3 for example, the panel element 60 includes more than one panel element 60*a*, 60*b*. For example, in one embodiment, the panel element 60 includes a pair of panel elements 60*a*, 60*b* where each of the panel elements 60*a*, 60*b* includes a second lateral edge 68 extending between the top end 62 and the bottom end 64. The second lateral edge 68 is disposed parallel to the first lateral edge. The first panel element 60*a* may be coupled to the second panel element 60*b* along the second lateral edge 68. The first panel element 60*a* may be coupled to the second panel element 60*b* via a bidirectional hinge 70, thereby enabling the reconfigurable neck pillow apparatus 10 to transition seamlessly between various desired configurations.

Figure 4:
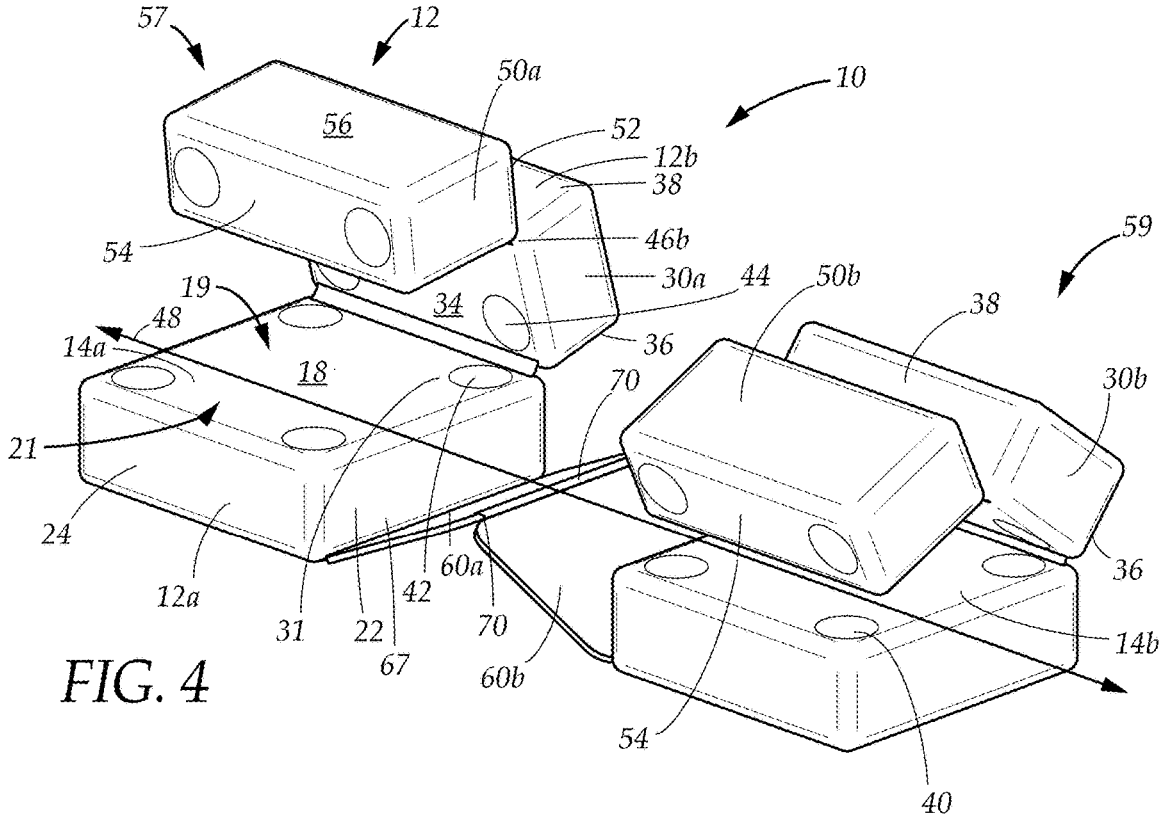
FIG. 4 is a front perspective view of one embodiment of the reconfigurable neck pillow apparatus being folded into a block configuration in accordance with some embodiments of the present disclosure.
Figure 5:
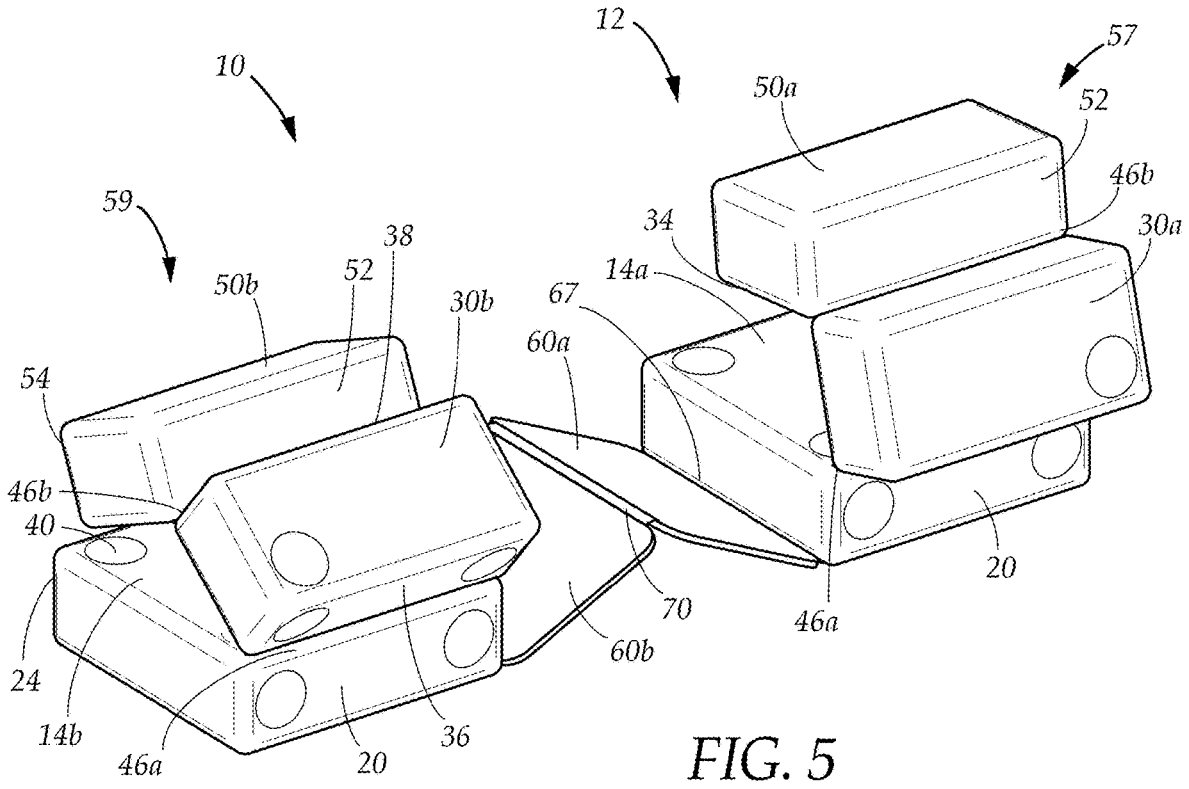
FIG. 5 is a rear perspective view of the reconfigurable neck pillow apparatus of FIG. 4.

Referring now to FIGS. 4 and 5, in some embodiments, each of the pair of side elements 14*a*, 14*b*, each of the pair of upper base elements 30*a*, 30*b*, each of the pair of lower base elements 50*a*, 50*b*, and each of the panel elements 60*a*, 60*b* is configured to move relative to each other such that the reconfigurable neck pillow apparatus 10 is reconfigurable from the extended configuration 78 (shown in FIGS. 2 and 3) into various other desired configurations. The desired configurations may include a standard configuration 80 (shown in FIG. 7), a low support configuration 82 (shown in FIG. 8), a high support configuration 84 (shown in FIG. 11), a block configuration 86 (shown in FIG. 6), a couples' configuration 88 (shown in FIG. 9), and/or any other desired configuration.

Referring again to FIGS. 4 and 5, in some embodiments, the orientation and/or operability of the various hinges 46*a*, 46*b*, 67, 70 relative to the interconnected cushions 12 determines a number of possible configurations. In some embodiments, the interconnected cushions 12 include at least one securing element 40 configured to releasably secure one interconnected cushion 12 to another interconnected cushion 12. The securing element 40 may be coupled to the interconnected cushion 12 via one or more adhesives, stitching, welding, bonding, pins, screws, and/or any other suitable fastening device or mechanism.

In some embodiments, the securing element 40 includes a first portion 42 coupled to or integrated with the first interconnected cushion 12*a* and a second portion 44 coupled to or integrated with the second interconnected cushion 12*b*. The first portion 42 may selectively engage the second portion 44 to secure the two interconnected cushions 12*a*, 12*b* in a desired configuration. In one embodiment, for example, the securing element 40 includes a pair of magnets 42, 44 having opposite charges, as shown in FIGS. 2 and 4). In other embodiments, the securing element 40 includes a snap, a hook and loop fastener, a button, and/or any other suitable mechanical device.

Referring again to FIGS. 4 and 5, in some embodiments, the first interconnected cushion 12*a* includes a side element 14*a* and the second interconnected cushion 12*b* includes an upper base element 30*a*. In one embodiment, one portion 42 of the securing element 40 is integrated into the side element 14*a* and another portion 44 of the securing element 40 is integrated into the upper base element 30*a* such that a position of the first portion 42 corresponds to a position of the second portion 44 when the first unidirectional hinge 46*a* is closed. In some embodiments, the first portion 42 thereby engages the second portion 44 to releasably secure the second surface 34 of the upper base element 30*a* adjacent to the outside surface 18 of the side element 14*a*. Of course, any number of securing elements 40 may be coupled to or integrated with any number of the interconnected cushions 12 in any desired positions, orientations, and/or configurations. In this manner, the securing element(s) 40 may facilitate securing the interconnected cushions 12 in a desired configuration.

Figure 6:
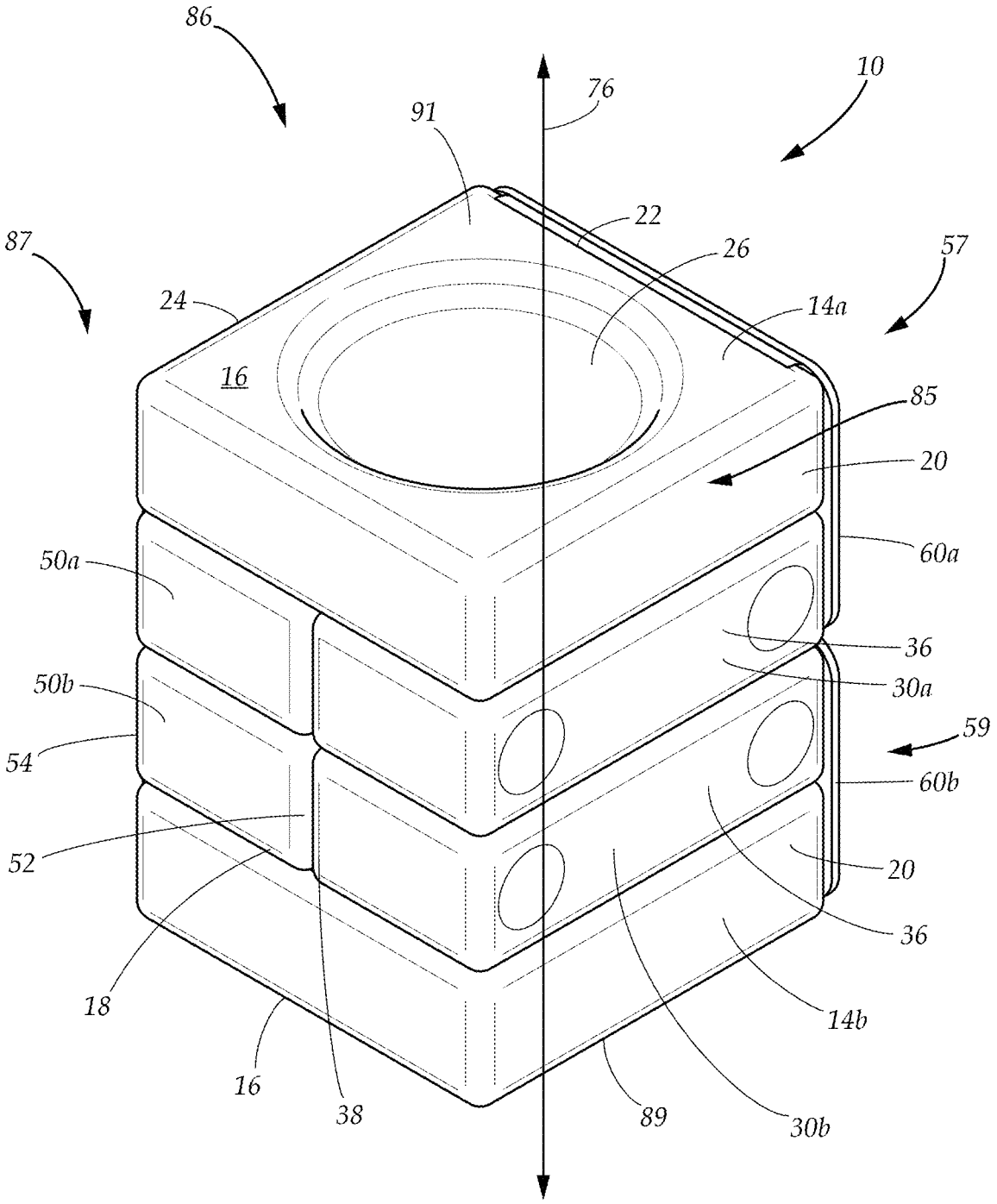
FIG. 6 is a perspective view of one embodiment of the reconfigurable neck pillow apparatus folded into a block configuration in accordance with some embodiments of the present disclosure.

Referring now to FIG. 6, while also referring to FIGS. 4 and 5, in some embodiments, the interconnected cushions 12 are configured to fold inwards on top of each other to form a block configuration 86 disposed along a vertical axis 76. Recognizing the common tendency of travelers to rest on a tray table, this configuration 86 may provide a raised support for a forward-leaning sleep posture, thereby cushioning the user's head while resting on a tray table.

In one embodiment, each of the pair of side elements 14*a*, 14*b* may be substantially aligned along the longitudinal axis 48. Each of the pair of upper base elements 30*a*, 30*b* may be substantially aligned with a corresponding one of the lower base elements 50*a*, 50*b* in a transverse direction with respect to the longitudinal axis 48. The first upper base element 30*a* and its corresponding first lower base element 50*a* may be folded on top of the first side element 14*a* to form a first cuboidal structure 57. Likewise, a second upper base element 30*b* and its corresponding second lower base element 50*b* may be folded on top of the second side element 14*b* to form a second cuboidal structure 59.

In some embodiments, the first cuboidal structure 57 is folded inward on top of the second cuboidal structure 59 to form a stacked block 87 having six (6) faces 85. In some embodiments, the bottom edge 20 of the second side element 14*b*, the top side 36 of the second upper base element 30*b*, the top side 36 of the first upper base element 30*a*, and the bottom edge 20 of the first side element 14*a* are aligned to form one face 85 of the stacked block 87. The first panel element 60*a* may be aligned with and disposed on top of the second panel element 60*b* such that the pair of panel elements 60*a*, 60*b* extend along another face 85 of the stacked block 87. In some embodiments, the pair of panel elements 60*a*, 60*b* extend between a bottom 89 of the stack 87 and a top 91 of the stack 87. In some embodiments, the inside surface 16 of the first side element 14*a* and its corresponding recess 26 are exposed on the top 91 of the stack 87.

Figure 7:
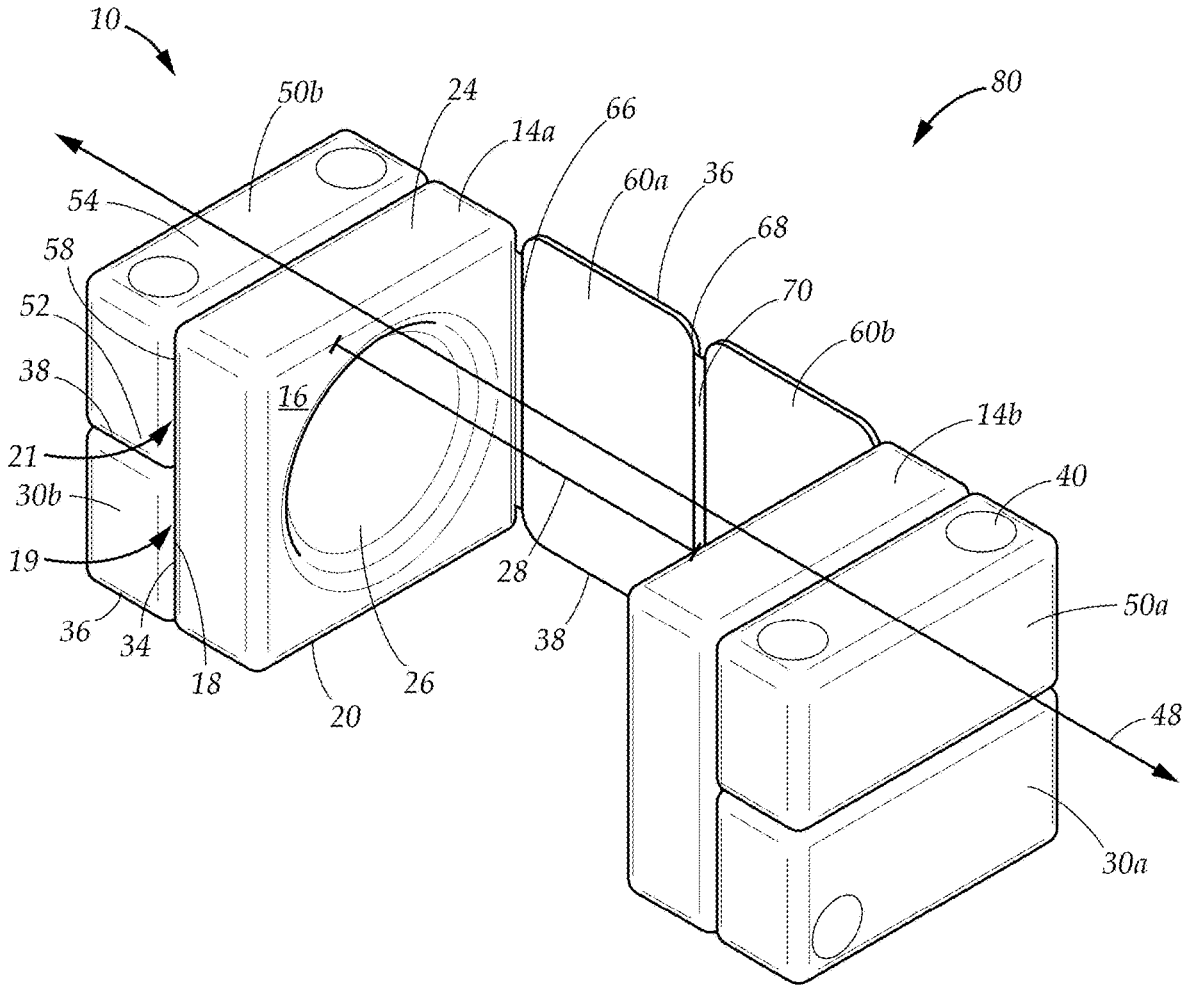
FIG. 7 is a perspective view of one embodiment of the reconfigurable neck pillow apparatus folded into a standard configuration in accordance with some embodiments of the present disclosure.

Referring now to FIG. 7, while also referring to FIGS. 4 and 5, in some embodiments, the reconfigurable neck pillow apparatus 10 may be configured into a standard configuration 80 designed to provide neck support for general use in various seated positions. The standard configuration 80 may offer baseline support and promote proper neck alignment during travel. In the standard configuration 80, each of the side elements 14*a*, 14*b* may be disposed substantially orthogonally with respect to the panel elements 60*a*, 60*b*. A space 28 may be formed between the pair of side elements 14*a*, 14*b* and may include dimensions sufficient to accommodate a user's head. In some embodiments, the space 28 includes dimensions (such as length and/or height, for example) substantially corresponding to the panel elements 60*a*, 60*b*.

In some embodiments, each of the upper base elements 30*a*, 30*b* is folded about one hundred eighty (180) degrees with respect to each of the side elements 14*a*, 14*b* such that the top side 36 substantially aligns with the bottom edge 20 and the second surface 34 abuts a lower portion 19 of the outside surface 18. Each of the pair of lower base elements 50*a*, 50*b* may be stacked on top of the corresponding upper base elements 30*a*, 30*b* such that the lower edge 54 of each of the lower base elements 50*a*, 50*b* substantially aligns with the top edge 24 of the corresponding side element 14*a*, 14*b* and the outer surface 58 abuts an upper portion 21 of the outside surface 18.

Figure 8:
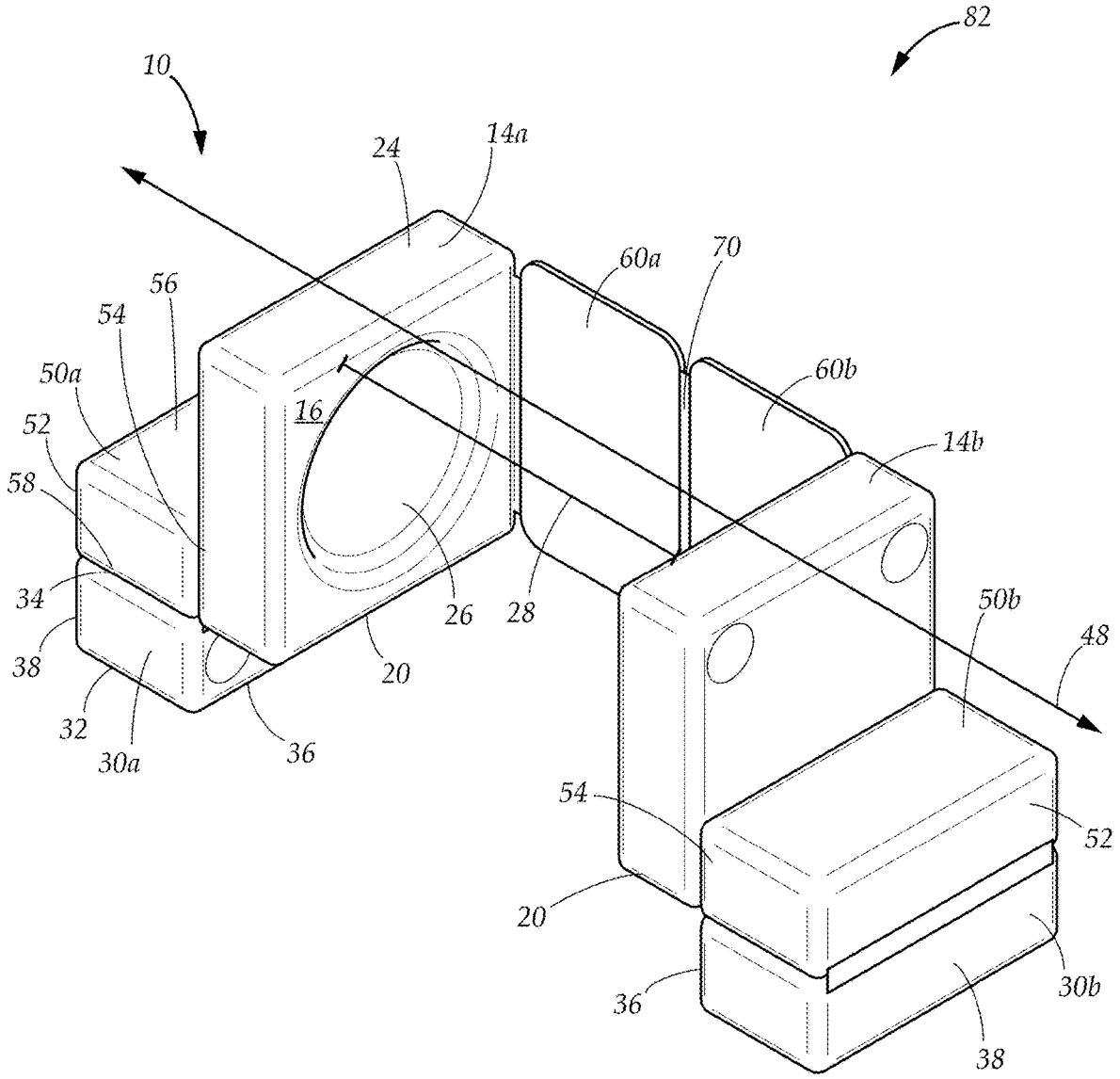
FIG. 8 is a perspective view of one embodiment of the reconfigurable neck pillow apparatus folded into a low support configuration in accordance with some embodiments of the present disclosure.

Referring now to FIG. 8, while also referring to FIGS. 4 and 5, in some embodiments, the low support configuration 82 includes each of the pair of side elements 14*a*, 14*b* being disposed orthogonally with respect to the pair of panel elements 60*a*, 60*b* to form the space 28. In certain embodiments, the panel elements 60*a*, 60*b* are oriented side-by-side and substantially coplanar with respect to each other 60*a*, 60*b*. In some embodiments, each of the side elements 14*a*, 14*b* is folded inwardly with respect to the panel elements 60*a*, 60*b* such that the inside surface 16 of one side element 14*a* faces the inside surface 16 of the other side element 14*b*, with the panel elements 60*a*, 60*b* defining a space 28 therebetween. The space 28 may include dimensions sufficient to receive the user's head. In some embodiments, the orientation of the side elements 14*a*, 14*b* may position the recess 26 of each of the side elements 14*a*, 14*b* to substantially correspond to one of the user's ears.

In some embodiments, each of the pair of upper base elements 30*a*, 30*b* may be pivoted about ninety (90) degrees in an outward direction with respect to each of the pair of side elements 14*a*, 14*b*. In this manner, the first surface 32 may be disposed parallel to and offset from the bottom edge 20. The second surface 34 of the pair of upper base elements 30*a*, 30*b* may contact or abut the outer surface 58 of a corresponding lower base element 50*a*, 50*b*.

Figure 9:
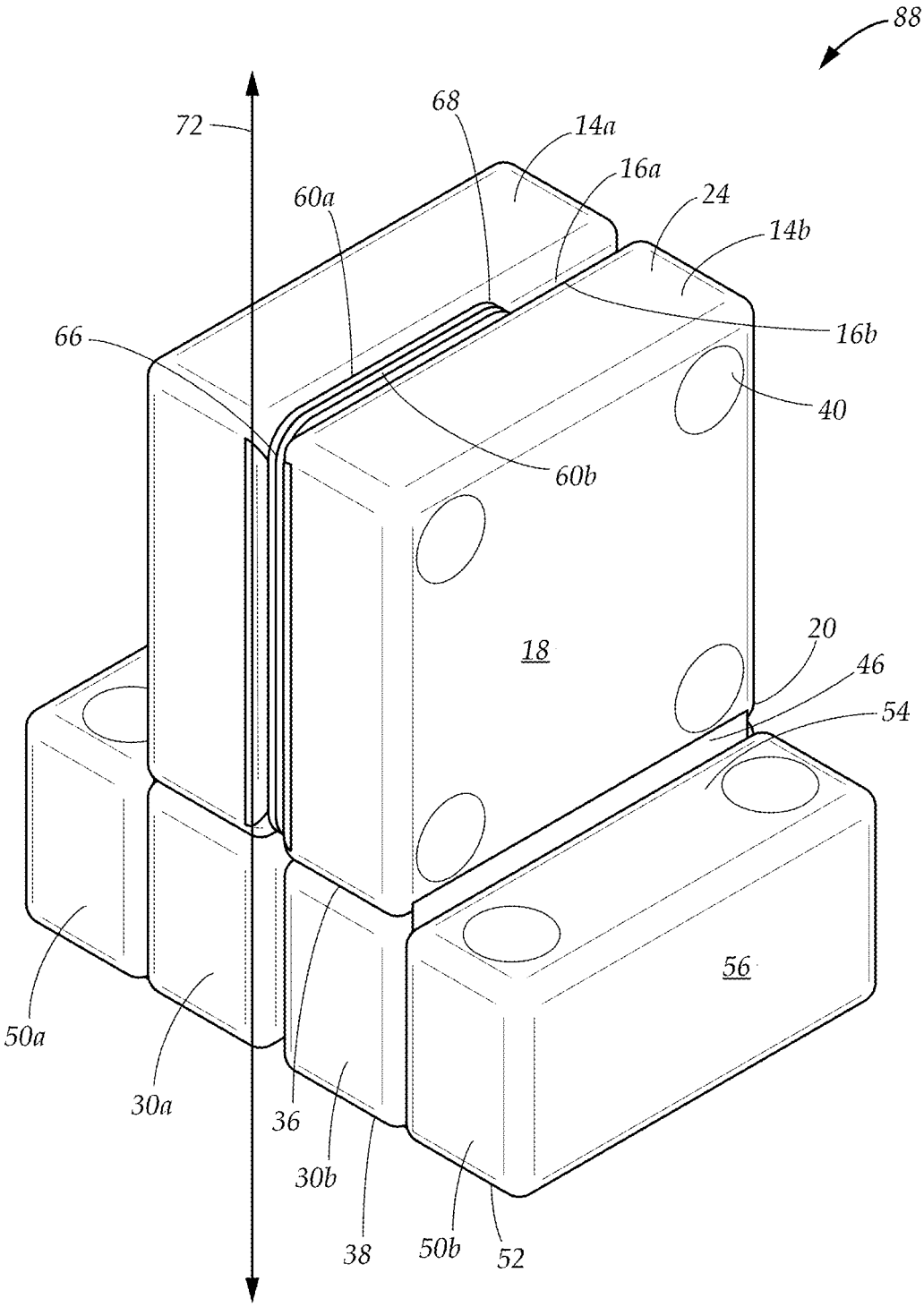
FIG. 9 is a perspective view of one embodiment of the reconfigurable neck pillow apparatus folded into a couples' configuration in accordance with some embodiments of the present disclosure.
Figure 10:
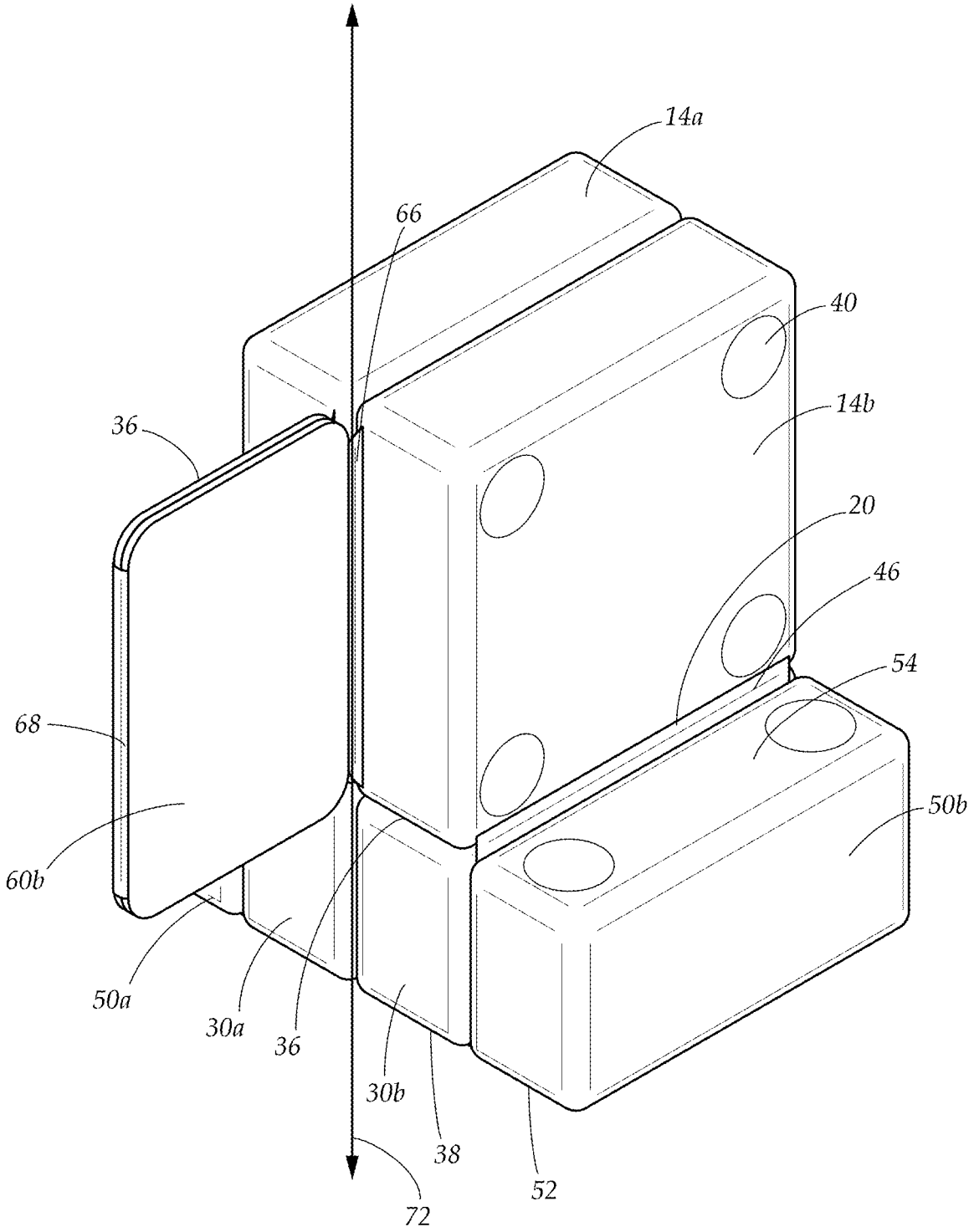
FIG. 10 is a perspective view of another embodiment of the reconfigurable neck pillow apparatus folded into a couples' configuration in accordance with some embodiments of the present disclosure.

Referring now to FIGS. 9 and 10, in some embodiments, the couples' configuration 88 is formed symmetrically along the transverse axis 72. The couples' configuration 88 may be designed for two users seated side by side. This configuration 88 may support the necks and/or heads of both users, thereby fostering a more intimate and shared travel or sleep experience.

In some embodiments, the couples' configuration 88 includes the pair of side elements 14*a*, 14*b* being folded inwardly onto each other such that the inside surface 16*a* of one of the pair of side elements 14*a* is disposed adjacent to the inside surface 16*b* of the other side element 14*b*. Each of the pair of side elements 14*a*, 14*b* may be aligned with and disposed on top of a corresponding upper base element 30*a*, 30*b*. Each of the pair of lower base elements 50*a*, 50*b* may be folded outwardly about one hundred eighty (180) degrees with respect to the corresponding upper base element 30*a*, 30*b* such that the lower edge 54 of the lower base element 50*a*, 50*b* is aligned and coplanar with the top side 36 of the upper base element 30*a*, 30*b*.

In the couples' configuration 88, in some embodiments, each of the pair of panel elements 60*a*, 60*b* folds inwardly onto each other such that the pair of panel elements 60*a*, 60*b* is sandwiched between the pair of side elements 14*a*, 14*b*. In other embodiments, the pair of panel elements 60*a*, 60*b* folds outwardly onto each other in a direction substantially perpendicular relative to the transverse axis 72.

Figure 11:
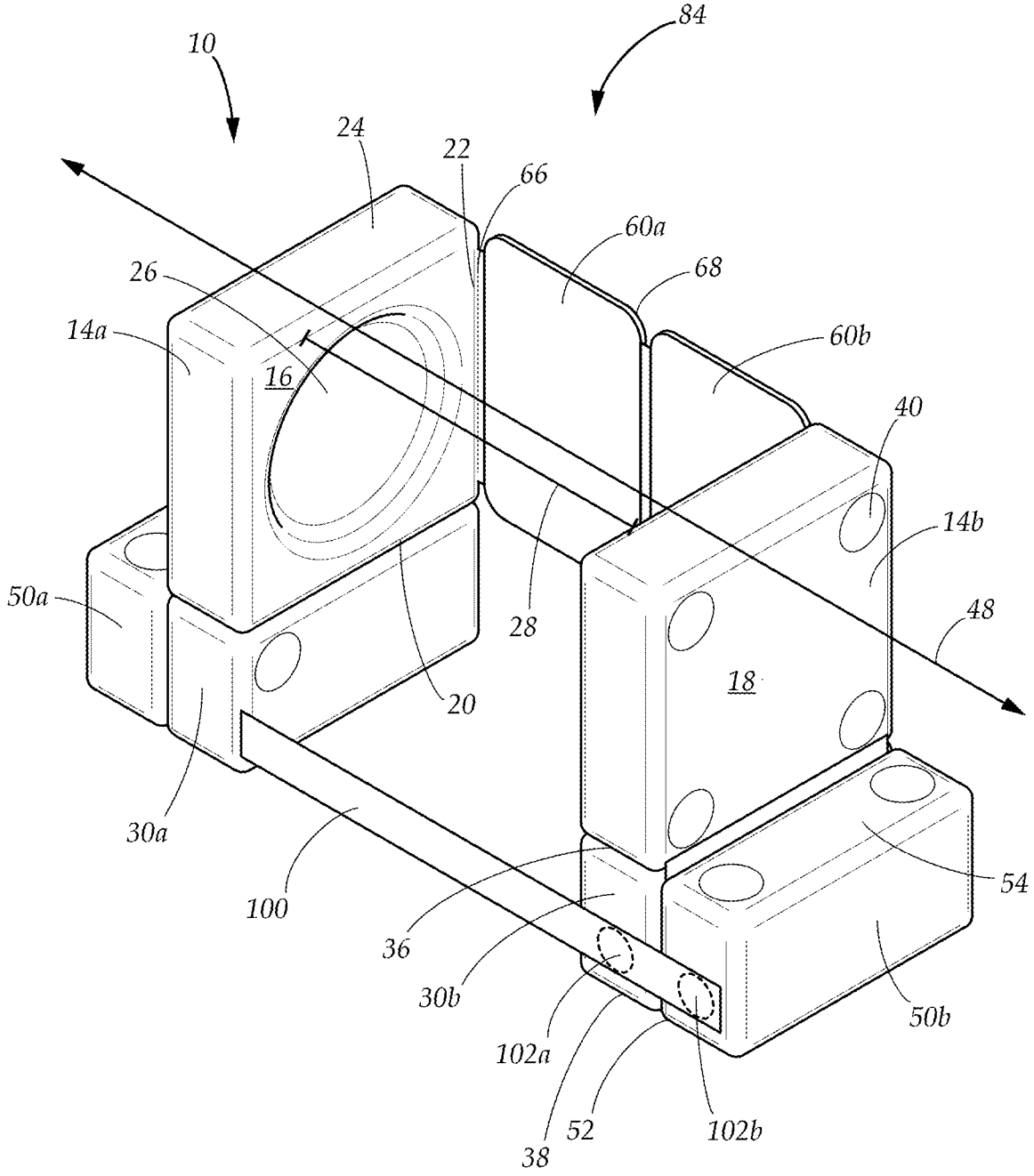
FIG. 11 is a perspective view of one embodiment of the reconfigurable neck pillow apparatus in a high support configuration and including a stabilizing element in accordance with some embodiments of the present disclosure.
Figure 12:
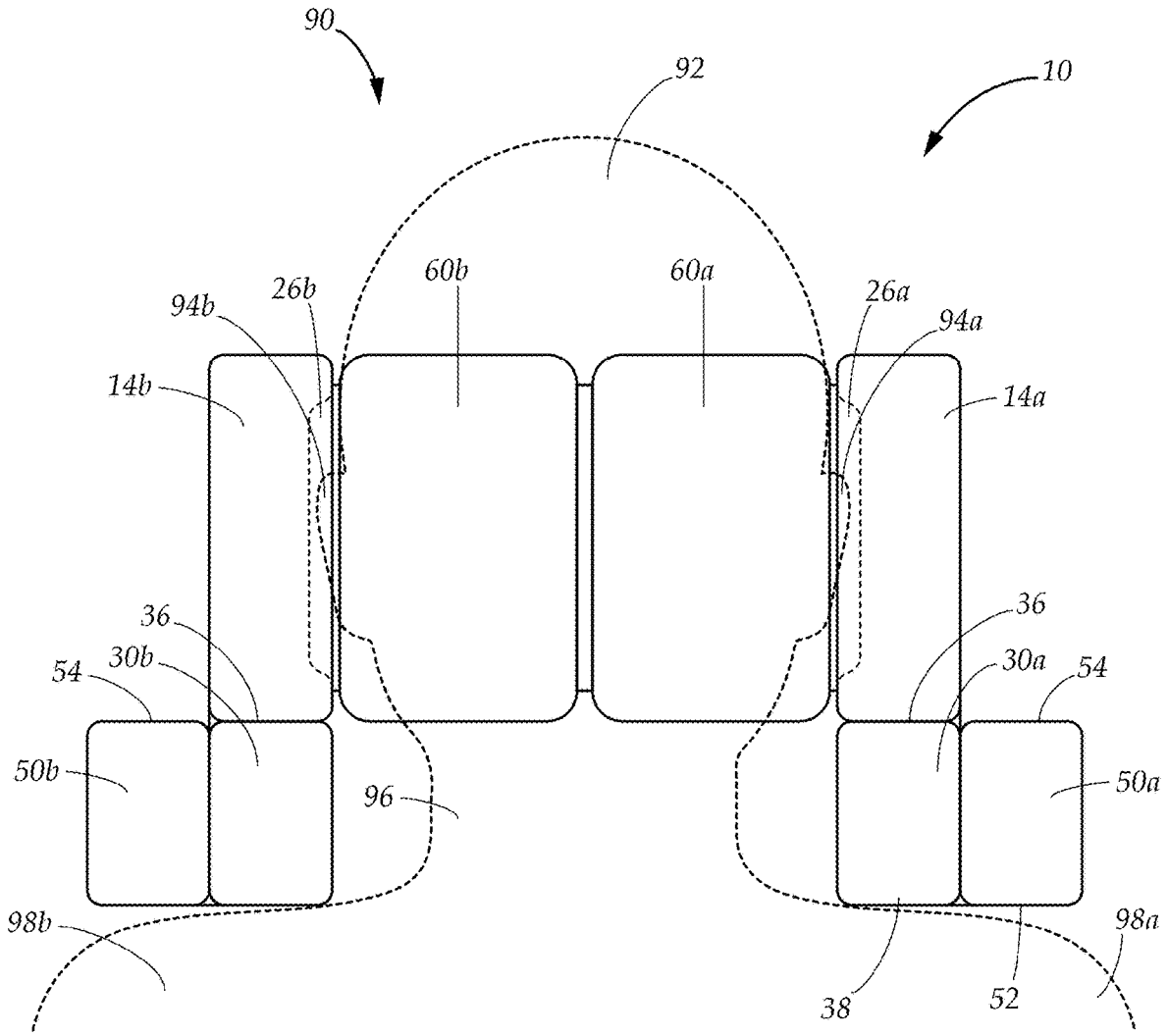
FIG. 12 is a rear view of one embodiment of the reconfigurable neck pillow apparatus in a high support configuration during use in accordance with some embodiments of the present disclosure.

Referring now to FIGS. 11 and 12, in some embodiments, the reconfigurable neck pillow apparatus 10 is configured into a high support configuration 84. In some embodiments, the high support configuration 84 is designed to offer additional support to prevent a user's head 92 from falling forward or sideways when the user 90 is asleep. The high support configuration 84 may thus prevent neck strain and unwanted head movement during sleep.

In the high support configuration 84, in some embodiments, each of the pair of side elements 14*a*, 14*b* is positioned orthogonally with respect to the pair of panel elements 60*a*, 60*b* to form the space 28 to receive the user's head 92. Each of the pair of side elements 14*a*, 14*b* may be aligned with and disposed on top of each of the pair of upper base elements 30*a*, 30*b*. Each of the pair of lower base elements 50*a*, 50*b* may be folded or rotated about one hundred eighty (180) degrees with respect to each of the upper base elements 30*a*, 30*b*. In this manner, in some embodiments, the lower edge 54 of the lower base elements 50*a*, 50*b* is substantially coplanar with the top side 36 of the corresponding upper base element 30*a*, 30*b* and the upper edge 52 of the lower base elements 50*a*, 50*b* is substantially coplanar with the bottom side 38 of its corresponding upper base element 30*a*, 30*b*.

During use, the reconfigurable neck pillow apparatus 10 may be positioned such that the user's shoulders 98*a*, 98*b* support the upper edge 52 of the lower base elements 50*a*, 50*b* and the bottom side 38 of the corresponding upper base elements 30*a*, 30*b*. The pair of panel elements 60*a*, 60*b* may contact the seat back and the user's head 92 may be positioned against the pair of panel elements 60*a*, 60*b* such that the reconfigurable neck pillow apparatus 10 is stabilized against the seat. In this position, each of the side elements 14*a*, 14*b* may cradle and support the user's head 92. In some embodiments, each of the user's ears 94*a*, 94*b* may be positioned within corresponding recesses 26*a*, 26*b* of each of the pair of side elements 14*a*, 14*b*. The reconfigurable neck pillow apparatus 10 may thus align and fully support the user's head 92 and neck 96 in a seated position, thereby preventing the user's head 92 from falling forward or to the side. In this manner, the reconfigurable neck pillow apparatus 10 may facilitate comfortable, uninterrupted sleep.

In some embodiments, a stabilizing element 100 may be coupled to the reconfigurable neck pillow apparatus 10 to stabilize a position of the reconfigurable neck pillow apparatus 10 relative to the user 90. In some embodiments, the stabilizing element 100 includes a flexible strap, band, cord, drawstring, clip, insert, frame, or any other suitable device or mechanism to stabilize the reconfigurable neck pillow apparatus 10 in a desired configuration.

In one embodiment, the stabilizing element 100 includes a strap coupled to each of the pair of side elements 14*a*, 14*b*. During use, the stabilizing element 100 may span at least a portion of the space 28 between the pair of side elements 14*a*, 14*b* and/or upper base elements 30*a*, 30*b* such that the user's head 92 and/or neck 96 is effectively stabilized and/or cradled therebetween. In some embodiments, the strap is releasably coupled to at least one of the pair of side elements 14*a*, 14*b* and/or pair of upper base elements 30*a*, 30*b* via at least one releasable fastener 102*a*, 102*b* such as a magnet, snap, button, hook and loop fastener, buckle, clip, and/or any other suitable releasable fastener known to those in the art.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

In conclusion, the disclosure is illustrated by example in the drawing figures, and throughout the written description. It should be understood that numerous variations are possible, while adhering to the inventive concept. Such variations are contemplated as being a part of the present disclosure.

What is claimed is:

1. A reconfigurable neck pillow apparatus, comprising:

a pair of side elements, each of the pair of side elements comprising an inside surface, an outside surface, the inside surface disposed opposite the outside surface, a bottom edge, a top edge, the bottom edge disposed substantially parallel to the top edge, each of the bottom edge and the top edge extending substantially perpendicularly between the inside surface and the outside surface, a side edge extending substantially transversely between the top edge and the bottom edge, and a recess disposed along the inside surface, wherein the recess is configured to accommodate an ear of a user, a pair of upper base elements, wherein each of the pair of upper base elements is hingedly coupled to at least a portion of one of the pair of side elements, wherein each of the pair of upper base elements comprises a first surface, a second surface, the first surface disposed opposite the second surface, a top side, and a bottom side, the top side disposed parallel to the bottom side, wherein the top side extends substantially perpendicularly between the first surface and the second surface, wherein the top side is disposed adjacent to the bottom edge of the corresponding one of the pair of side elements, and wherein each of the pair of upper base elements is substantially coplanar with the one of the pair of side elements in an extended configuration;

a pair of lower base elements, wherein each of the pair of lower base elements is hingedly coupled to at least a portion of one of the pair of upper base elements, wherein each of the pair of lower base elements comprises an outer surface, an inner surface, an upper edge, and a lower edge, the upper edge disposed parallel to the lower edge, wherein the upper edge is disposed adjacent to the bottom side of the corresponding one of the pair of upper base elements, and wherein the pair of lower base elements are substantially coplanar with each other and the pair of side elements in the extended configuration; and a panel element, wherein the panel element comprises a top end, a bottom end, and a first lateral edge extending between the top end and the bottom end, wherein the first lateral edge is hingedly coupled to the side edge of one of the pair of side elements such that the panel element is disposed between and substantially coplanar with the pair of side elements in the extended configuration, wherein the pair of side elements, the pair of upper base elements, the pair of lower base elements, and the panel element are foldable with respect to each other to form various configurations.

2. The reconfigurable neck pillow apparatus of claim 1, further comprising a plurality of interconnected cushions including a rectangular prism shape.

3. The reconfigurable neck pillow apparatus of claim 2, wherein the panel element is hingedly coupled to the side edge via a third hinge.

4. The reconfigurable neck pillow apparatus of claim 3, wherein the panel element comprises a pair of panel elements, wherein each of the pair of panel elements comprises a second lateral edge extending between the top end and the bottom end and disposed parallel to the first lateral edge.

5. The reconfigurable neck pillow apparatus of claim 4, wherein each of the pair of panel elements is substantially rigid.

6. The reconfigurable neck pillow apparatus of claim 5, wherein the pair of panel elements comprises a first panel element coupled to a second panel element along the second lateral edge.

7. The reconfigurable neck pillow apparatus of claim 6, wherein the first panel element is coupled to the second panel element via a bidirectional hinge.

8. The reconfigurable neck pillow apparatus of claim 4, wherein each of the pair of side elements, each of the pair of upper base elements, each of the pair of lower base elements, and each of the panel elements is reconfigurable from the extended configuration to a configuration selected from the group consisting of a standard configuration, a low support configuration, a high support configuration, a block configuration, and a couples configuration.

9. The reconfigurable neck pillow apparatus of claim 8, wherein the standard configuration comprises each of the pair of side elements being disposed orthogonally with respect to the pair of panel elements to form a space to receive a user's head, each of the pair of upper base elements being folded with respect to each of the pair of side elements such that the top side aligns with the bottom edge, and each of the pair of lower base elements being stacked on top of each of the pair of upper base elements such that the lower edge aligns with the top edge.

10. The reconfigurable neck pillow apparatus of claim 8, wherein the low support configuration comprises each of the pair of side elements being disposed orthogonally with respect to the pair of panel elements to form the space to receive the user's head, each of the pair of upper base elements being folded with respect to each of the pair of side elements, the first surface being disposed parallel to and offset from the bottom edge, and the second surface of the pair of upper base elements being disposed adjacent to the outer surface of the pair of lower base elements.

11. The reconfigurable neck pillow apparatus of claim 8, wherein the high support configuration comprises each of the pair of side elements being disposed orthogonally with respect to the pair of panel elements to form the space to receive the user's head, each of the pair of side elements being aligned with and disposed on top of each of the pair of upper base elements, and each of the pair of lower base elements being folded with respect to each of the pair of upper base elements such that the lower edge is coplanar with the bottom side.

12. The reconfigurable neck pillow apparatus of claim 8, wherein the block configuration comprises each of the pair of side elements, each of the pair of upper base elements, and each of the pair of lower base elements being folded onto each other to form a cuboidal shape.

13. The reconfigurable neck pillow apparatus of claim 8, wherein the couples' configuration comprises the pair of side elements being folded inwardly onto each other such that the inside surface of one of the pair of side elements is adjacent to the inside surface of another of the pair of side elements, wherein each of the pair of side elements is aligned with and disposed on top of each of the pair of upper base elements, and wherein each of the pair of lower base elements is folded with respect to each of the pair of upper base elements such that the lower edge is coplanar with the bottom side.

14. The reconfigurable neck pillow apparatus of claim 13, wherein each of the pair of panel elements folds onto the other and extends outwardly in a substantially transverse direction relative to the side edge.

15. The reconfigurable neck pillow apparatus of claim 2, further comprising at least one securing element configured to releasably couple a first interconnected cushion to a second interconnected cushion of the plurality of interconnected cushions.

16. The reconfigurable neck pillow apparatus of claim 15, wherein the securing element comprises a first portion coupled to the first interconnected cushion and a second portion coupled to the second interconnected cushion, and wherein the first portion selectively engages the second portion.

17. The reconfigurable neck pillow apparatus of claim 8, further comprising a stabilizing element configured to stabilize the configuration during use, wherein the stabilizing element is releasably coupled to at least two of the plurality of interconnected cushions and configured to span at least a portion of a space formed to receive a user's head.

18. The reconfigurable neck pillow apparatus of claim 1, wherein each of the pair of upper base elements is coupled to one of the pair of side elements via a first unidirectional hinge.

19. The reconfigurable neck pillow apparatus of claim 1, wherein each of the pair of lower base elements is coupled to the corresponding one of the pair of upper base elements via a second unidirectional hinge.

* * * * *